US005505179A

United States Patent [19]

Brennan

[11] Patent Number: 5,505,179

[45] Date of Patent: Apr. 9, 1996

[54] METHOD AND APPARATUS FOR INFERRING MANIFOLD ABSOLUTE PRESSURE IN TURBO-DIESEL ENGINES

[75] Inventor: Daniel G. Brennan, Brighton, Mich.

[73] Assignee: Ford Motor Company, Dearborn, Mich.

[21] Appl. No.: 316,993

[22] Filed: Oct. 3, 1994

[51] Int. Cl.[6] ..... F02M 51/00

[52] U.S. Cl. ..... 123/479

[58] Field of Search ..... 123/479, 399, 123/488, 494, 419, 417, 492, 493, 422, 423; 364/431.11, 431.12, 431.05

[56] References Cited

U.S. PATENT DOCUMENTS

| | | | |
|---|---|---|---|
| 4,886,030 | 12/1989 | Oba et al. | 123/488 |
| 5,012,422 | 4/1991 | Takahashi et al. | 364/431.05 |
| 5,125,384 | 6/1992 | Tada | 123/479 |
| 5,190,012 | 3/1993 | Takahashi | 123/479 |
| 5,270,935 | 12/1993 | Dudek et al. | 364/431.01 |
| 5,276,619 | 1/1994 | Ohara et al. | 123/479 |
| 5,331,560 | 7/1994 | Tamura | 364/431.12 |
| 5,343,840 | 9/1994 | Wataya et al. | 123/399 |
| 5,384,707 | 1/1995 | Kerns et al. | 364/431.11 |

*Primary Examiner*—Raymond A. Nelli
*Attorney, Agent, or Firm*—Allan J. Lippa; Roger L. May

[57] ABSTRACT

An electronic engine controller for a diesel engine controls the mass of fuel injected by fuel injectors within the engine by receiving a Manifold Absolute Pressure (MAP) signal, from a MAP sensor positioned in an intake manifold of the engine, and generating a value indicative of the mass of fuel to be injected by the fuel injectors as a function of the MAP signal. The engine controller also generates an estimate of the absolute air pressure existing in the intake manifold by retrieving a value from a table containing a plurality of values indicative of an absolute air pressure for a given engine speed and fuel injection quantity. If the MAP sensor fails then the engine controller utilizes the estimate to generate the value indicative of the mass of fuel to be injected by the fuel injectors.

16 Claims, 3 Drawing Sheets

METHOD AND APPARATUS FOR INFERRING MANIFOLD ABSOLUTE PRESSURE IN TURBO-DIESEL ENGINES

FIELD OF THE INVENTION

This invention relates to the field of electronic engine control and more particularly to the field of controlling a turbo-diesel engine in the event of a failed manifold absolute pressure sensor.

BACKGROUND OF THE INVENTION

Engine controllers for diesel engines typically determine the amount of fuel injected to the combustion chambers of the engine as a function of the average absolute air pressure existing in the engine manifold. The average absolute air pressure is typically generated by an air pressure sensor, often referred to as a MAP (Manifold Absolute Pressure) sensor, which is positioned in the intake manifold and which generates a signal indicative of the average absolute air pressure existing in the intake manifold.

If the MAP sensor fails, certain engine controllers utilize a default MAP value for continued operation until the MAP sensor can be replaced. Utilizing a default value however provides less than optimum performance and emissions control because a default value which is indicative of low MAP value can result in reduced power, while a default value which is indicative of high MAP can result in increased emissions.

Accordingly, there is a need for an engine controller which can provide improved power and reduced emissions in the event of a MAP sensor failure.

SUMMARY OF THE INVENTION

It is an object of the present invention to provide improved power and reduced emissions in a diesel engine in the event of a MAP sensor failure by estimating the absolute pressure existing in the intake manifold.

In accordance with the primary object of the invention, in a preferred embodiment, an engine controller receives, from a manifold absolute pressure sensor, a manifold absolute pressure signal which is indicative or an average absolute air pressure within an intake manifold of the engine. A manifold absolute pressure value is generated as a function of the manifold absolute pressure signal. The engine controller also receives an engine speed signal which is indicative of the rotational speed of the engine. A fuel injection value, indicative of an amount of fuel to be injected by one or more fuel injectors within the engine is determined as a function of the manifold absolute pressure value. An inferred manifold absolute pressure value is generated as a function of the fuel injection value and the engine speed value. A failure occurring in the manifold absolute pressure sensor is detected and in response to the detected failure, a subsequent fuel injection value is determined as a function of the inferred manifold absolute pressure value.

An advantage of certain preferred embodiments is engine operation in the event of a MAP sensor failure continue without producing the increased emissions or suffering from the reduced power of known systems.

These and other features and advantages of the present invention may be better understood by considering the following detailed description of a preferred embodiment of the invention. In the course of this description, reference will frequently be made to the attached drawings.

DETAILED DESCRIPTION

Figure 1:
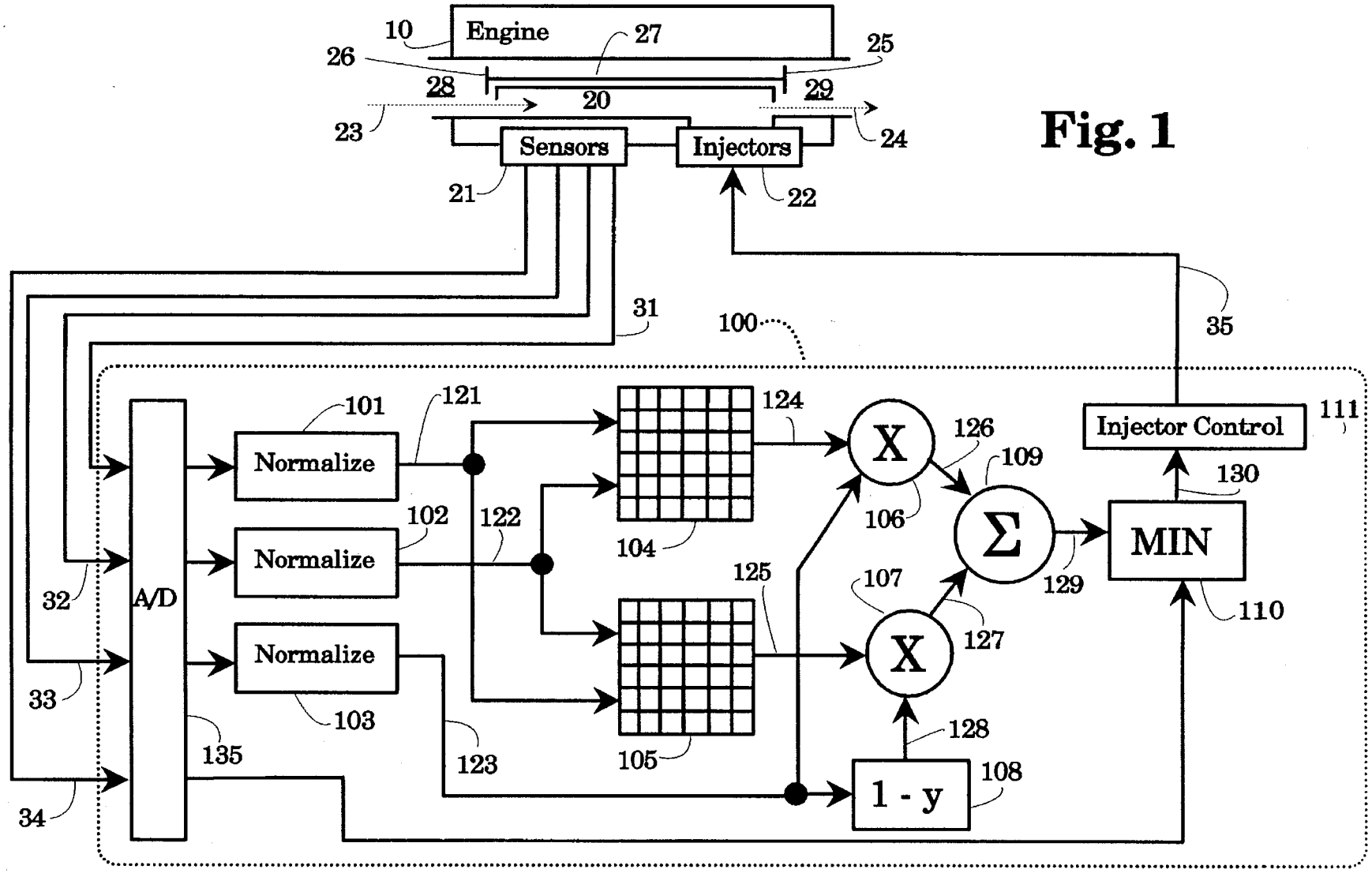
FIG. 1 of the drawings shows a block diagram of a preferred embodiment.

FIG. 1 shows a block diagram of a diesel engine 10 and an engine controller 100 which controls the operation of the engine. Engine 10 is conventional and preferably includes a turbocharger 27 which has an exhaust turbine 25 and intake turbine 26. Turbocharger 27 operates in a conventional manner to compress air entering intake manifold 28 in response to exhaust gas exiting exhaust manifold 29. Dotted line 23 denotes the flow of air past intake turbine 26, into a plurality of combustion chambers seen generally at 20, and dotted line 25 denotes the flow of exhaust gas out or combustion chambers 20 and past exhaust turbine 25. Engine 10 includes a plurality of fuel injectors, seen generally at 22, with each fuel injector positioned to deliver fuel to a corresponding combustion chamber. A plurality of sensors seen generally at 21, include a manifold absolute pressure (MAP) sensor which transmits a MAP signal 32 which is indicative of average absolute air pressure existing in intake manifold 28, an RPM sensor which transmits an RPM signal 31 which is indicative of the rotational speed of the engine, a barometric pressure sensor which transmits a barometric pressure (BP) signal 33 which is indicative of an atmospheric barometric pressure, and a pedal position signal 34 indicative of a fuel quantity desired by a driver of the vehicle as represented by the position of an accelerator pedal (not shown) in the vehicle.

Engine controller receives signals 31, 32, 33 and 34 and generates a fuel injection value, which is indicative of an amount of fuel to be injected by injectors 22, over fuel delivery signal 35. Engine controller 100 preferably comprises a central processing unit (CPU), a read-only memory (ROM) for storing control programs, a random-access memory (RAM) for temporary data storage, a keep-alive-memory (KAM) for storing learned values and a conventional data bus. Engine controller 100 also includes analog-to-digital converters for generating digital values from analog signals 31, 32, 33 and 34, and generating analog signal 35 from the fuel injection value.

Engine controller 100 operates to generate fuel delivery signal 35 by generating digital values from signals 31, 32, 33 and 34. A MAP value indicative of average absolute air pressure existing in the intake manifold is generated from MAP signal 32, an RPM value indicative of the rotational speed of the engine is generated from RPM signal 31, a BP value indicative of the atmospheric barometric pressure is generated from BP signal 33, and a pedal position value indicative of the position of the accelerator pedal is generated from pedal position signal 34.

The RPM value, MAP value and BP value are each normalized at blocks 101,102 and 103 respectively. The normalized RPM value and MAP value obtained from blocks 101 and 102 respectively are used as indices to tables 104 and 105. Tables 104 and 105 advantageously contain a plurality of values, indexed by engine speed and manifold absolute pressure, which are indicative of a maximum allowed injected mass fuel. Table 104, designated herein as low altitude table, contains empirically determined values indicative of mass of fuel to be injected at low altitudes and table 105, designated herein as high altitude table, contains similarly derived values indicative of mass of fuel to be injected at high altitudes.

Low altitude value 124 retrieved from table 104 is multiplied at 106 with the normalized value 123 of barometric pressure to create an input 126 for summing element 109. High altitude value 125 retrieved from table 105 is multiplied at 107 with a modified BP value 128 to create an input 127 for summing element 109. Block 108 generates output 128 by subtracting input 123, which has a value between zero and one, from the value one. Summing element 109 generates intermediate fuel injection value 129 by adding inputs 126 and 127 which are indicative respectively of a fuel injection quantity at low altitude and high altitude as modified by atmospheric barometric pressure. Block 110 compares intermediate fuel injection value 129 to the pedal position value received from pedal position signal 34 and generates a fuel injection value 130 corresponding to the minimum of the intermediate fuel injection value and the pedal position value. Injector control block 111 generates fuel delivery signal 35 as a function of fuel injection value 130.

Figure 2A:
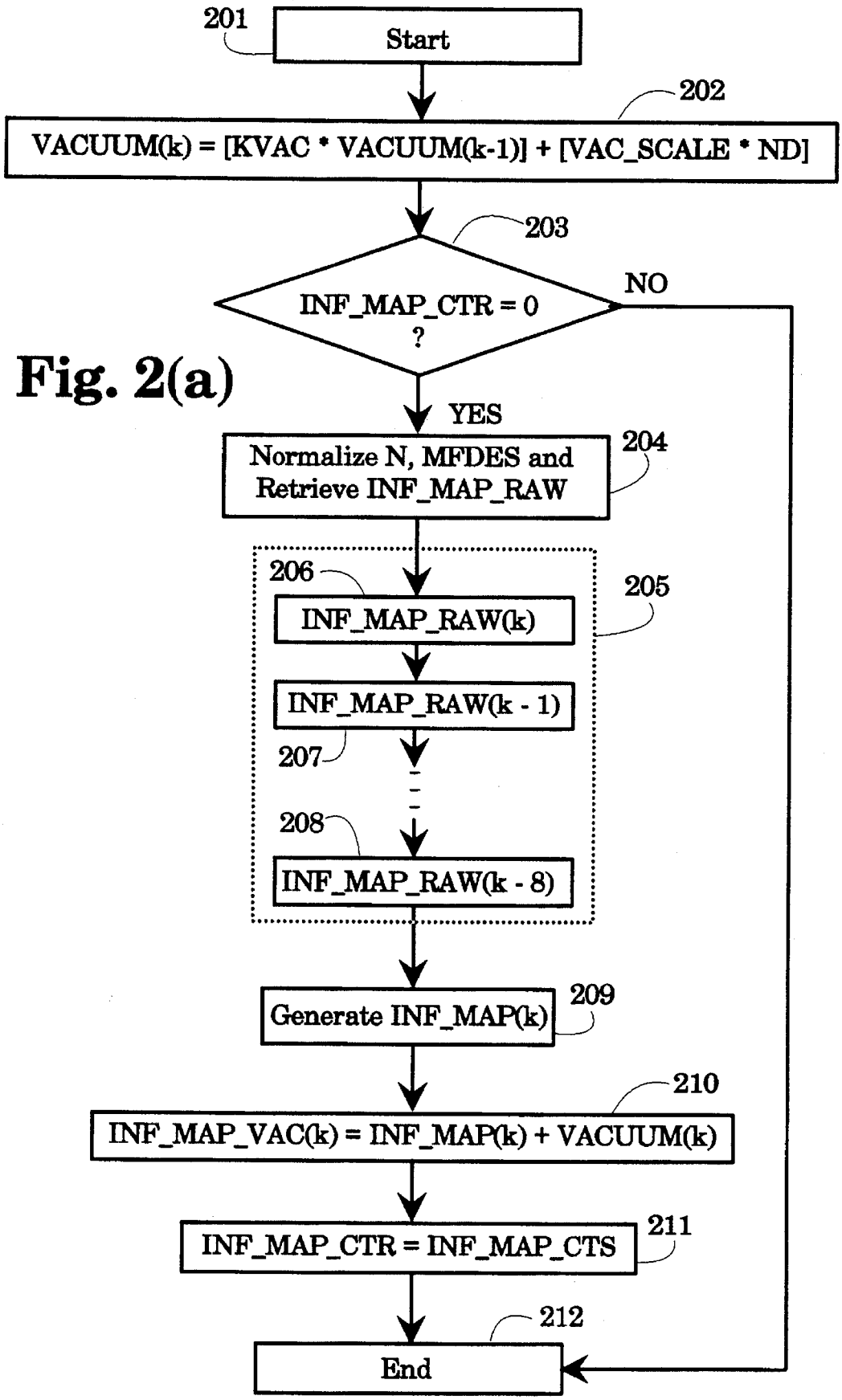
FIGS. 2(*a*) and 2(*b*) are flowcharts showing the operation of a preferred embodiment.
Figure 2B:
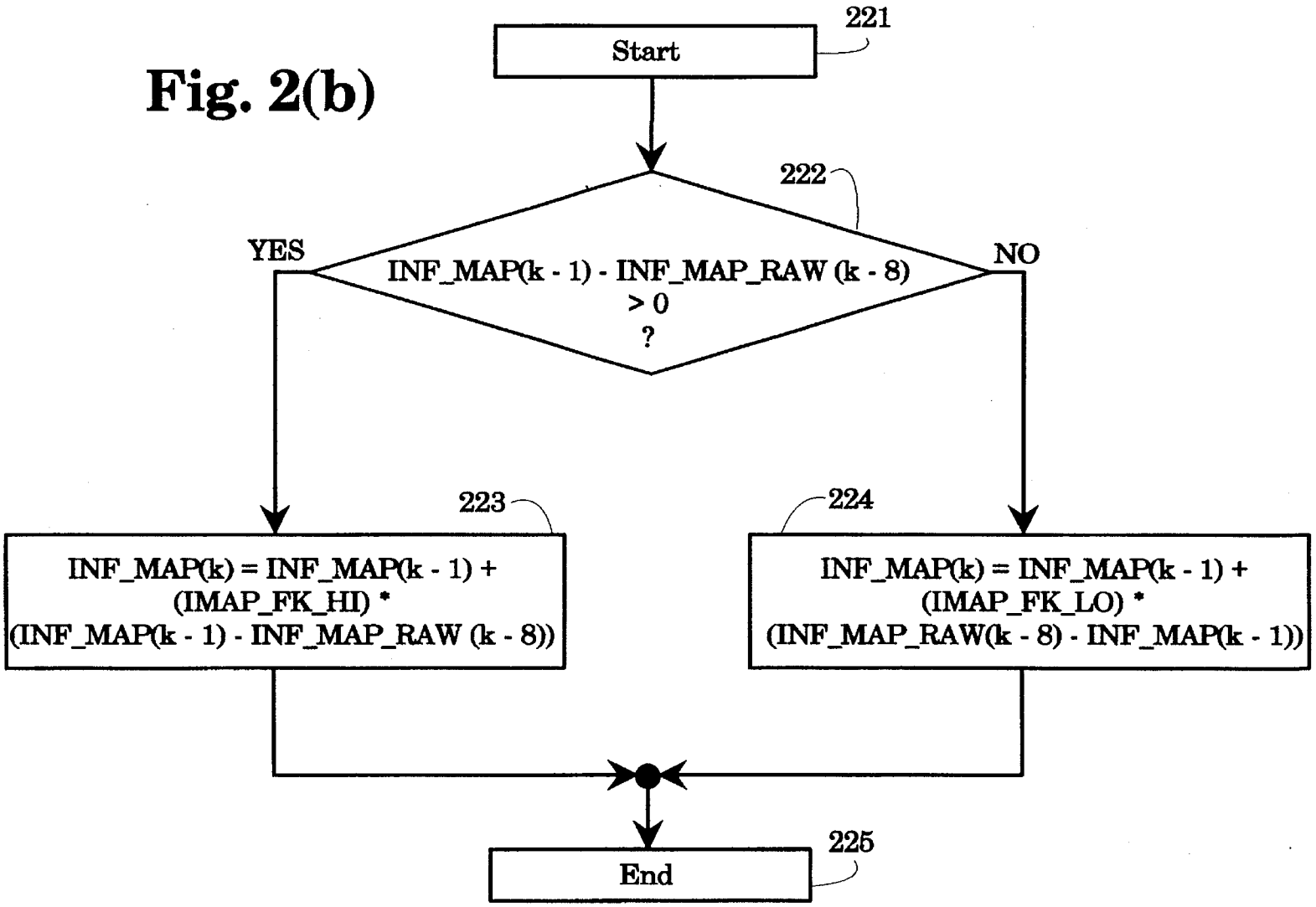

A preferred embodiment advantageously generates an estimated manifold absolute pressure value for use in the event of a failure in the MAP sensor in the manner shown in FIGS. 2(*a*) and 2(*b*). The steps shown in FIGS. 2(*a*) and 2(*b*) implement an estimated MAP routine which is executed in a background routine by engine controller 100. In the event of a MAP sensor failure, the estimated MAP value generated by the steps of FIGS. 2(*a*) and 2(*b*) is used in place of the MAP value generated from MAP signal 32 to generate fuel delivery value 130.

FIG. 2(*a*) is initiated at 201 and at 202 a vacuum value VACUUM(k), which is indicative of a temporary vacuum created in the intake manifold by rotation of the intake turbine of the turbocharger due to engine acceleration or deceleration is calculated as a function of engine speed and a prior vacuum value by the relationship shown at 202, where KVAC is a calibration constant used to scale the variable VACUUM(k–1), VACUUM(k–1) is the prior calculated value of the vacuum in the intake manifold, VAC_SCALE is a calibration constant used to scale variable ND, and ND is the change in the rotational speed of the engine in RPMs per second.

At 203, the value of a counter, designated as INF_MAP_CTR is checked to determine if a predetermined amount of time has elapsed to determine an estimated MAP value. The counter INF_MAP_CTR is periodically decremented, preferably once every millisecond, from a predetermined value INF_MAP_CTS which as seen at 211 is loaded into INF_MAP_CTR at the end of the MAP routine. Because the MAP routine is executed as a part of a larger background routine, INF_MAP_CTR advantageously ensures that the MAP routine is executed only after the passage of time determined by INF_MAP_CTS. Consequently, if a time equal to the value of INF_MAP_CTS has not elapsed, then the routine is exited. If the value in INF_MAP_CTR is equal to zero, then at 204, engine speed N as received in the manner shown in FIG. 1 is normalized as is a value MFDES which corresponds to the present value of the fuel injection value. The normalized values are used to retrieve a raw inferred manifold absolute pressure value from a MAP estimation table. The MAP estimation table contains a plurality of empirically determined values indicative of average manifold absolute pressure values which exist at different values of engine speed N, and fuel injection MFDES. Such values advantageously provide an estimate of the average manifold absolute pressure which exists for different engine speeds and fuel injection values.

At 205, the retrieved raw inferred manifold absolute pressure value INF_MAP_RAW is delayed for a predetermined delay time by storing it in a First-in-First-Out (FIFO) type buffer. The FIFO buffer preferably contains N locations, with N preferably equal to a value of eight locations, three of which are shown at 205. Each of the eight locations in the FIFO buffer stores a value of INF_MAP_RAW retrieved during execution of the MAP routine. Thus, the most recently retrieved value of INF_MAP_RAW is stored in the FIFO buffer along with seven prior retrieved values of INF_MAP_RAW. The value INF_MAP_RAW(k) is the most recently retrieved raw inferred manifold absolute pressure value, INF_MAP_RAW(k–1) is the raw inferred manifold absolute pressure value retrieved in the prior execution of the MAP routine and INF_MAP_RAW(k–7) is the eighth prior raw inferred manifold absolute pressure value. The FIFO buffer operates in a conventional manner by concurrently storing the value INF_MAP_RAW(k) and generating the value INF_MAP_RAW(k–7). The time delay required for INF_MAP_RAW(k) to be moved through the FIFO buffer and be retrieved eight MAP routines later advantageously approximates the time required for exhaust gas to be propelled from a combustion chamber of the engine to the exhaust turbine of the turbocharger. As will be appreciated by those skilled in the art in view of the present disclosure, the size of the FIFO buffer may be altered to optimize for different engine configurations where the time required for exhaust gas to be propelled from the combustion chamber to the exhaust turbine may vary. In addition, the rate at which INF_MAP_CTR is decremented, or the value of INF_MAP_CTS may also be altered to allow for different engine configurations.

At 209, a filtered MAP value INF_MAP(k) is generated by performing a filtering procedure to compensate for the intertia of the turbocharger. The steps performed at 209 are shown in greater detail in FIG. 2(*b*). At 222, a test is made to determine if the engine is under an acceleration condition, where the driver of the vehicle desires an increase in engine speed, or under a deceleration condition where the driver of the vehicle desires a decrease in engine speed. As can be seen, this comparison is advantageously performed by comparing two values indicative of manifold absolute pressure value as determined at two prior points in time. If the difference between INF_MAP(k–1) and INF_MAP_RAW(k–8) is greater than zero then the engine is determined to be under an acceleration condition, and step 223 is executed. Otherwise, the engine is determined to be under a deceleration condition and the step at 224 is executed.

Steps 223 and 224 implement a low-pass filter to generate a filtered MAP value, INF_MAP(k), by filtering the raw inferred manifold absolute pressure as a function of the inertia of the turbocharger to generate the value INF_MAP(k). At step 223, IMAP_FK_HI is a predetermined value indicative of desired time lag during acceleration and is determined as a function of the time required for the turbocharger to respond to a change in the velocity of the exhaust gas impacting the exhaust turbine during acceleration, plus an added desired delay time. At step 224, IMAP_FK_LO is a value indicative of the time required for the turbocharger to respond to a change in the velocity of the exhaust gas impacting the exhaust turbine during deceleration. As will be appreciated by those skilled in the art in view of the present disclosure, the time required for the turbocharger to respond to a change in the velocity of the exhaust gas impacting the exhaust turbine will be substantially similar during acceleration or deceleration. A preferred embodiment advantageously utilizes different values, IMAP_FK_HI and IMAP_FL_LOW, to represent the time required for the turbocharger to respond to a change in the velocity of the exhaust gas impacting the exhaust turbine during acceleration and for deceleration to indicate a degradation in vehicle performance during acceleration to the driver of the vehicle. Response during deceleration is advantageously optimized so as to reduce excess emissions caused during deceleration. By causing degraded performance during acceleration and maintaining optimized performance during deceleration, a preferred embodiment advantageously creates an incentive to a driver of the vehicle to have a failed MAP sensor repaired quickly while providing reduced emissions in the interim.

Once a value for INF_MAP(k) is generated at steps 223 or 224, the inferred ma nifold absolute pressure value INF_MAP_VAC(k) which is indicative of the average absolute air pressure existing in the intake manifold is calculated at step 210 in FIG. 2(*a*) by adding the filtered MAP value INF_MAP(k) to the vacuum value VACUUM(k). Finally, at step 211, INF_MAP_CTS is set equal to the value INF_MAP_CTS which is a constant indicative of the initial value of INF_MAP_CTS.

The value INF_MAP_VAC(k) is utilized to determine the fuel injection value in manner shown in FIG. 1 if the MAP sensor is determined to have failed. In a preferred embodiment, the MAP sensor takes the form of a monolithic string gauge which generates an voltage indicative of the average absolute air pressure in the intake manifold. A voltage to frequency converter is preferably utilized to convert the voltage into an electrical signal which has a corresponding frequency, for transmission to engine controller 100. The signal transmitted is preferably an electrical signal having a frequency in the range of 180–240 Hz. Engine controller 100 receives the signal, converts the analog signal to a digital value, and compares the digital value to a minimum and maximum frequency value which together define a range of acceptable frequency values. If the signal generated by the MAP sensor results in a corresponding digital value which is outside of the range of acceptable frequency values, then the MAP sensor is determined by the engine controller to be faulty, and the inferred manifold absolute pressure value is utilized to calculate the fuel injection value.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. Apparatus for controlling emissions produced by a diesel engine comprising:

a microprocessor programmed to receive, from a manifold absolute pressure sensor, a manifold absolute pressure signal which is indicative of an average absolute air pressure within an intake manifold of said engine;

generate a manifold absolute pressure value as a function of said manifold absolute pressure signal;

receive an engine speed signal which is indicative of the rotational speed of said engine;

determine, as a function of said manifold absolute pressure value, a fuel injection value indicative of an amount of fuel to be injected by one or more fuel injectors within said engine;

detect, in response to a signal transmitted by said manifold absolute pressure sensor, a failure in said manifold absolute pressure sensor;

generate an inferred manifold absolute pressure value as a function of said fuel injection value and said engine speed value; and respond to said failure by determining a subsequent fuel injection value as a function of said inferred manifold absolute pressure value; and fuel injection means for injecting an amount of fuel which corresponds to said fuel injection value,

2. Apparatus as set forth in claim 1 wherein the microprocessor is programmed to generate an inferred manifold absolute pressure value by:

retrieving a manifold absolute pressure value from a table which comprises a plurality of manifold absolute pressure values indexed by mass of fuel injected and engine speed; and generating said inferred manifold absolute pressure value as a function of said retrieved manifold absolute pressure value.

3. Apparatus as set forth in claim 2 wherein the engine includes a turbocharger and the microprocessor generates said inferred manifold absolute pressure value as a function of said retrieved manifold absolute pressure value by;

delaying said retrieved manifold absolute pressure value for a predetermined period of time to generate a delayed manifold absolute pressure value; and responding to the expiration of said predetermined period of time by, generating said inferred manifold absolute pressure value as a function of said delayed retrieved manifold absolute pressure value and a filter value which is indicative of the inertia of said turbocharger.

4. Apparatus as set forth in claim 3 wherein the predetermined period of time is indicative of the time required for exhaust gas to be propelled from a combustion chamber of said engine to said turbocharger.

5. Apparatus as set forth in claim 4 wherein the microprocessor generates said inferred manifold absolute pressure value as a function of said delayed retrieved manifold absolute pressure value and a filter value which is indicative of the inertia of said turbocharger by;

determining whether said engine is under an acceleration condition or a deceleration condition;

utilizing an acceleration value, which is indicative of a desired time lag during acceleration, as said filter value if said engine is under said acceleration condition; and utilizing a deceleration value, which is indicative of a time lag during deceleration caused by the inertia of said turbocharger, as said filter value if said engine is under said deceleration condition.

6. Apparatus as set forth in claim 5 wherein the microprocessor delays said retrieved manifold absolute pressure value for a predetermined period of time to generate a delayed manifold absolute pressure value by:

utilizing a first-in-first-out (FIFO) type of storage means to store said retrieved manifold absolute pressure value said FIFO type of storage means having a total of N storage locations and storing said retrieved manifold absolute pressure value at a first location and storing a plurality of prior retrieved manifold absolute pressure values at N–1 different locations;

retrieving for N–1 predetermined periodic intervals, each of said plurality of prior retrieved manifold absolute pressure values;

generating said delayed manifold absolute pressure value by retrieving at an Nth periodic interval said retrieved manifold absolute pressure value, said Nth periodic interval being delayed from the storage of said retrieved manifold absolute pressure value by said predetermined period of time.

7. Apparatus as set forth in claim 6 wherein the the microprocessor determines whether said engine is under an acceleration condition or a deceleration condition by:

comparing a first prior inferred manifold absolute pressure value which was stored in said FIFO type storage means a periodic interval prior to said inferred manifold absolute pressure value, to an Nth prior inferred manifold absolute pressure value which was stored in said FIFO type storage means N periodic intervals prior to said inferred manifold absolute pressure value;

determining said engine to be under said acceleration condition if said first prior inferred manifold absolute pressure value is greater than said Nth prior inferred manifold absolute pressure value; and determining said engine to be under said deceleration condition if said first prior inferred manifold absolute pressure value is less than said Nth prior inferred manifold absolute pressure value.

8. Apparatus as set forth in claim 7 wherein the microprocessor retrieves a manifold absolute pressure value from a table which comprises a plurality of manifold absolute pressure values indexed by mass of fuel injected and engine speed by;

normalizing said fuel injection value and said engine speed value to generate a normalized fuel injection value and a normalized engine speed value; and utilizing said normalized fuel injection value and said normalized engine speed value as indices to said table to retrieve said manifold absolute pressure value.

9. Apparatus as set forth in claim 8 wherein the microprocessor generates an inferred manifold absolute pressure value by:

generating a vacuum value indicative of a vacuum created in said intake manifold by said turbocharger; and generating said inferred manifold absolute pressure value as a function of said vacuum value.

10. Apparatus as set forth in claim 2 wherein the microprocessor generates an inferred manifold absolute pressure value by:

generating a vacuum value, which is indicative of a vacuum created in said intake manifold by said turbocharger, as a function of said engine speed value; and generating said inferred manifold absolute pressure value as a function of said vacuum value.

11. An engine controller for a diesel engine which includes a turbocharger for providing compressed air to a plurality of exhaust chambers of said engine from air entering an intake manifold of said engine, and a plurality of fuel injectors, each positioned to deliver fuel to a combustion chamber of said engine, the engine controller comprising:

a microprocessor programmed to generate an engine speed value indicative of the rotational speed of said engine;

generate a fuel injection value indicative of the mass of fuel injected into a combustion chamber of said engine;

respond to said engine speed value by generating a vacuum value indicative of a vacuum created by acceleration or deceleration of said engine;

generate an estimate value indicative of an average absolute pressure within said intake manifold of said engine as a function of engine speed value, said fuel injection value and said vacuum value;

detect a failure of a manifold absolute pressure sensor positioned within said intake manifold; and utilize said estimate value to determine a fuel injection amount indicative of an amount of fuel to be injected by said fuel injectors; and means, responsive to said fuel injection amount, for transmitting a fuel injection signal to said fuel injectors to cause delivery, of an amount of fuel by said fuel injectors corresponding to said fuel injection amount.

12. The engine controller set forth in claim 11 wherein the microprocessor generates said estimate value indicative of an average absolute pressure within said intake manifold of said engine by:

responding to said engine speed value and to said fuel injection value by retrieving a first value from a plurality of stored predetermined values;

delaying said first value by a predetermined delay value to compensate for the time required for exhaust gas to be propelled from one of said combustion chambers of said engine to an exhaust turbine of said turbocharger;

responding to the expiration of said predetermined delay value by altering said delayed first value as a function of the inertia of said turbocharger; and generating said estimate value as a function of said altered and delayed first value.

13. The engine controller as set forth in claim 12 wherein the microprocessor delays said first value by a predetermined delay value by use of a first-in-first-out buffer which has a predetermined number of storage locations and at predetermined periodic intervals concurrently stores a value at a first location and provides a value from an Nth location which was stored in said first-in-first-out buffer for a time period which substantially equals said predetermined delay value.

14. Apparatus for controlling delivery of fuel to an intake manifold in diesel engine which employs a turbo charger for compressing air entering the combustion chamber of said engine through an intake manifold, said turbo charger having a rotational delay which creates a vacuum in said intake manifold during acceleration and deceleration, said apparatus, comprising:

a microprocessor programmed to:

determine an engine speed value which is indicative of the rotational speed of said engine;

calculate a present vacuum value as a function of a prior vacuum value and said engine speed value;

determine a fuel injection value indicative of a mass of fuel injected into each cylinder of said engine per cylinder firing;

retrieve an inferred manifold absolute pressure value as a function of said engine speed value and said fuel injection value;

delay said retrieved inferred manifold absolute pressure value for a predetermined period of time to generate a delayed inferred manifold absolute pressure value;

determine whether said engine is under an acceleration condition or a deceleration condition;

filter said delayed inferred manifold absolute pressure value by an acceleration filtering value if said engine is under an acceleration condition and filter said inferred manifold absolute pressure value by a deceleration filtering value if said engine is under a deceleration condition, to generate a filtered inferred manifold absolute pressure value;

generate said estimate of the absolute air pressure within said intake manifold by adding said present vacuum value to said filtered inferred manifold absolute pressure value; and generate a fuel delivery value, indicative of an amount of fuel to be delivered to said intake manifold in accordance with said estimate; and fuel injection means for injecting an amount of fuel corresponding to said fuel delivery value into said intake manifold.

15. Apparatus as set forth in claim 14 wherein the microprocessor generates said estimate at periodic intervals during operation of said engine.

16. Apparatus as set forth in claim 15 wherein the predetermined amount of time is indicative of a time delay required for said exhaust gas to be propelled from a combustion chamber of said engine to said turbocharger.

* * * * *